US006651852B2

(12) United States Patent
Arellano

(10) Patent No.: US 6,651,852 B2
(45) Date of Patent: Nov. 25, 2003

(54) BEVERAGE DISPENSING SYSTEM

(76) Inventor: Martin Arellano, 38 Franklin Ct., Garden City, NY (US) 11530

( * ) Notice: Subject to any disclaimer, the term of this patent is extended or adjusted under 35 U.S.C. 154(b) by 28 days.

(21) Appl. No.: 09/935,105

(22) Filed: Aug. 22, 2001

(65) Prior Publication Data

US 2003/0038145 A1 Feb. 27, 2003

(51) Int. Cl.[7] ..... B65D 83/14
(52) U.S. Cl. ..... 222/399; 222/400.07
(58) Field of Search ..... 222/399, 400.7; 251/149.6

(56) References Cited

U.S. PATENT DOCUMENTS 4,148,459 A * 4/1979 Martinez ..... 251/149.6
4,418,848 A * 12/1983 Lunau ..... 222/504
4,735,348 A * 4/1988 Santoiemmo et al. ..... 222/399
5,115,942 A * 5/1992 Merrill et al. ..... 222/1
5,115,947 A * 5/1992 McDonnell et al. ..... 222/107
5,303,733 A * 4/1994 Nelson ..... 137/505.38
5,443,186 A * 8/1995 Grill ..... 222/396
5,598,869 A * 2/1997 Nelson ..... 137/505.11

* cited by examiner

*Primary Examiner*—Gene Mancene
*Assistant Examiner*—Patrick Buechner
(74) *Attorney, Agent, or Firm*—Fish & Richardson P.C.

(57) ABSTRACT

A beverage dispensing system including at least one beverage container assembly. Each beverage container assembly includes a beverage container, a gas container, and a regulator cap assembly. The regulator cap assembly has a beverage coupler for receiving the beverage container and a gas coupler for receiving the gas container. The gas coupler includes a first channel which is connected to a regulator valve for regulating the gas through a second channel such that it fills the beverage container enabling the contents of the beverage container to flow out through an outlet valve.

15 Claims, 13 Drawing Sheets

BEVERAGE DISPENSING SYSTEM

BACKGROUND

The present invention generally relates to beverage dispensing systems.

Typically, beverages such as beer and soda are supplied to consumers in containers including bottles and cans. A beverage such as beer may also be sold in containers such as barrels or kegs but hold only one variety of beer at a time. Generally, individual consumers and establishments that serve small quantities of beverages purchase these beverages in bottles and cans. In addition, although containers such as barrels or kegs that hold large quantities of beer are available, they require large storage compartments and are difficult to maintain at a proper temperature.

Conventional beer dispensing systems use barrels or kegs requiring large and bulky compressed gas containers for providing a source of pressure for dispensing the beer. To dispense beer from a container such as a barrel or keg, a storage compartment is needed that is capable of maintaining the container at a proper temperature for extended periods of time. These storage compartments are often large and cumbersome and use cooling methods that are inefficient over long periods of time.

A further drawback of many conventional beer dispensing systems is that the shelf life for these beverages tends to be short once the containers are opened or tapped for dispensing. A beverage such as beer stored in barrels or kegs that is not immediately consumed are often discarded if not maintained under proper pressure.

In addition, another problem associated with traditional beverage dispensing systems is that for the individual consumer or small restaurant proprietor, the selection of beverages is limited to a single barrel and a single selection which may lack appeal to consumers who prefer a variety of beers.

SUMMARY

In general, according to one aspect, the invention features a beverage dispensing system that includes a refrigerate compartment for storing at least one beverage container assembly. Each beverage container assembly includes a beverage container, a gas container, and a regulator cap assembly. The regulator cap assembly includes a beverage coupler for receiving the beverage container and a gas coupler for receiving the gas container. The gas coupler includes a first channel which is connected to a regulator valve having a first end connected to the first channel through which the gas travels. The regulator valve also has a second end which is connected to a second channel through which the gas is allowed to travel such that the gas fills the beverage container enabling the contents of the beverage container to flow out through an outlet valve. The beverage dispensing system also includes a controlling means for controlling the flow of a beverage between the outlet valve and a dispensing nozzle.

Various aspects of the invention may include one or more of the following features. The first coupler may have a threaded end for receiving the gas container. The controlling means uses a solenoid to control the flow of the beverage through the dispensing nozzle. The outlet valve may be a ball lock valve. The temperature within the refrigerated compartment can be maintained at a range of approximately 38° to 40° Fahrenheit. The gas container may contain at least one of a carbon dioxide gas and nitrogen gas at a pressure of approximately 1800 pound square inch (psi).

The regulator valve may be a diaphragm regulator valve and may include a means of adjusting the pressure of the gas that passes through the regulator valve. The regulator valve may be capable of regulating the gas in the first channel from approximately 1800 psi to approximately 0 to 50 psi in the second channel.

The invention may provide one or more of the following advantages. The beverage dispensing system is capable of maintaining a proper pressure in a beverage container, when the beverage dispensing system is not providing pressure to force the beverage out from the beverage container. This can permit the freshness of the beverage in the beverage container to be maintained for an extended period of time. The beverage dispensing system includes a refrigerated compartment that is capable of holding at least one beverage container assembly at a proper temperature. The refrigerated compartment is able to maintain this proper temperature within the compartment by using a low cost and compact cooling system.

Each beverage container assembly includes a regulator cap assembly which can be directly coupled to a gas container without using an external hose. This provides a low cost solution to maintaining a proper environment for the beverage container. This also allows the refrigerated compartment to hold at least one beverage container assembly since the size of each assembly is compact. The refrigerated compartment typically is able to contain 4 beverage container assemblies where each assembly includes a gas container, a regulator cap assembly, and a beverage container.

The details of one or more embodiments of the invention are set forth in the accompanying drawings and the description below. Other features and advantages of the invention will be apparent from the description and drawings, and from the claims.

DESCRIPTION OF DRAWINGS

Like reference symbols in the various drawings indicate like elements.

DETAILED DESCRIPTION

Figure 1:
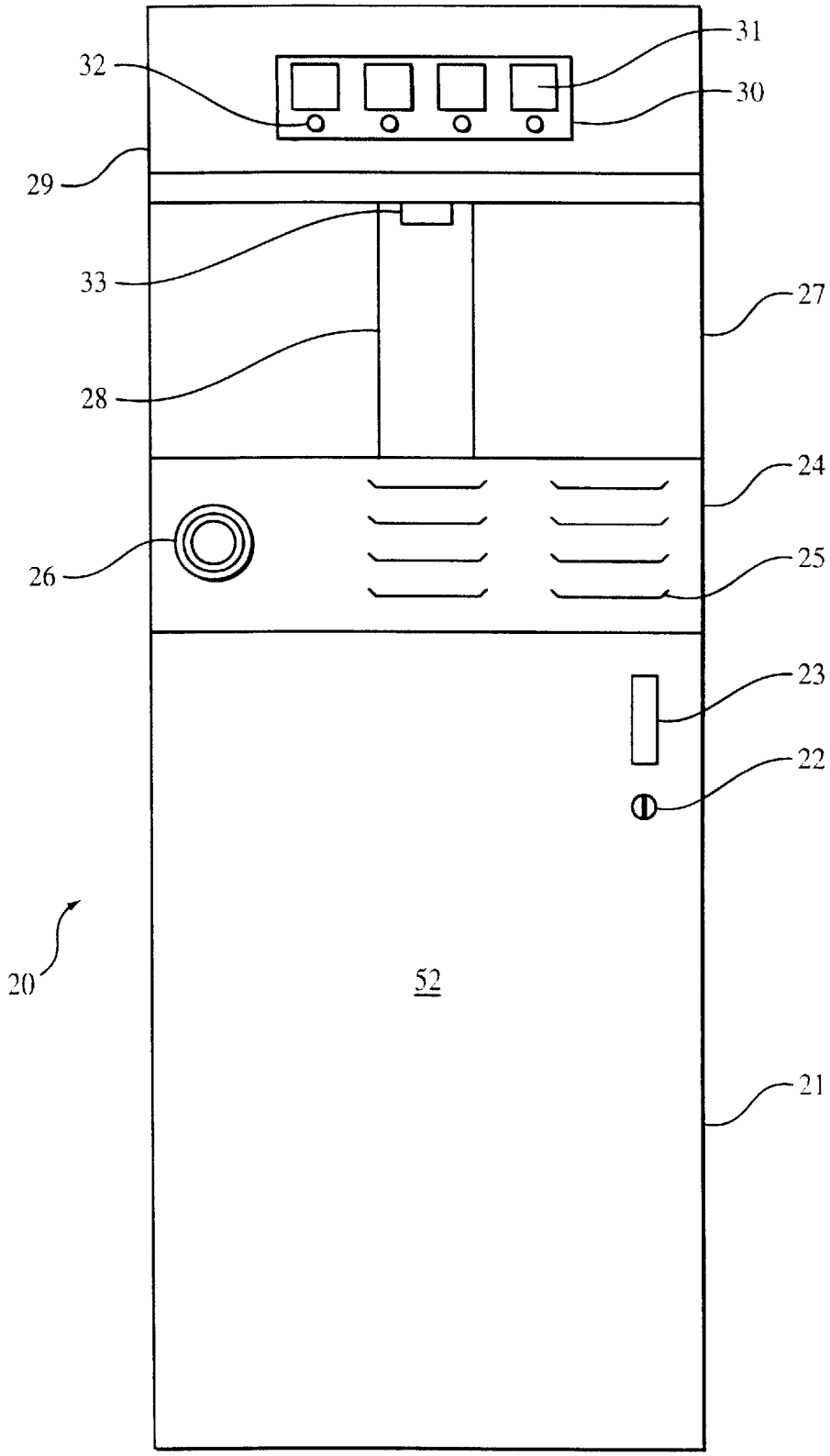
FIG. 1 illustrates a front view of an embodiment of a beverage dispensing system according to the present invention.

FIGS. 1–7 illustrate different views of a beverage dispensing system 20 according to the present invention. Referring to FIG. 1, the beverage dispensing system 20 includes a hinged compartment door 52 having a key lock 22 for preventing unauthorized access to the interior of a refrigerated compartment 21. Once the key lock 22 is unlocked or opened, a door handle 23 can be used to gain access to the interior of the refrigerated compartment 21.

Situated over the refrigerated compartment 21, is a vented base 24 which allows airflow and heat to be dissipated through one or more vents 25 and away from the beverage dispensing system 20. On top of the vented base 24, is a tower stand 27 that contains a beverage tower 28, a beverage selection panel housing 29, and a beverage selection panel 30. The beverage selection panel 30 contains a beverage name frame 31 and push button beverage flow controls 32. Attached to the bottom of the beverage selection panel housing 29 is a beverage dispensing nozzle 33 from which beverages are dispensed. Each push button beverage flow control 32 is associated with a particular beverage and provides a means for dispensing a beverage once a particular push button is depressed. A cup dispenser 26 is part of the vented base 24 and can be used to house cups for holding beverages when they are dispensed from the beverage dispensing nozzle 33.

Figure 2A:
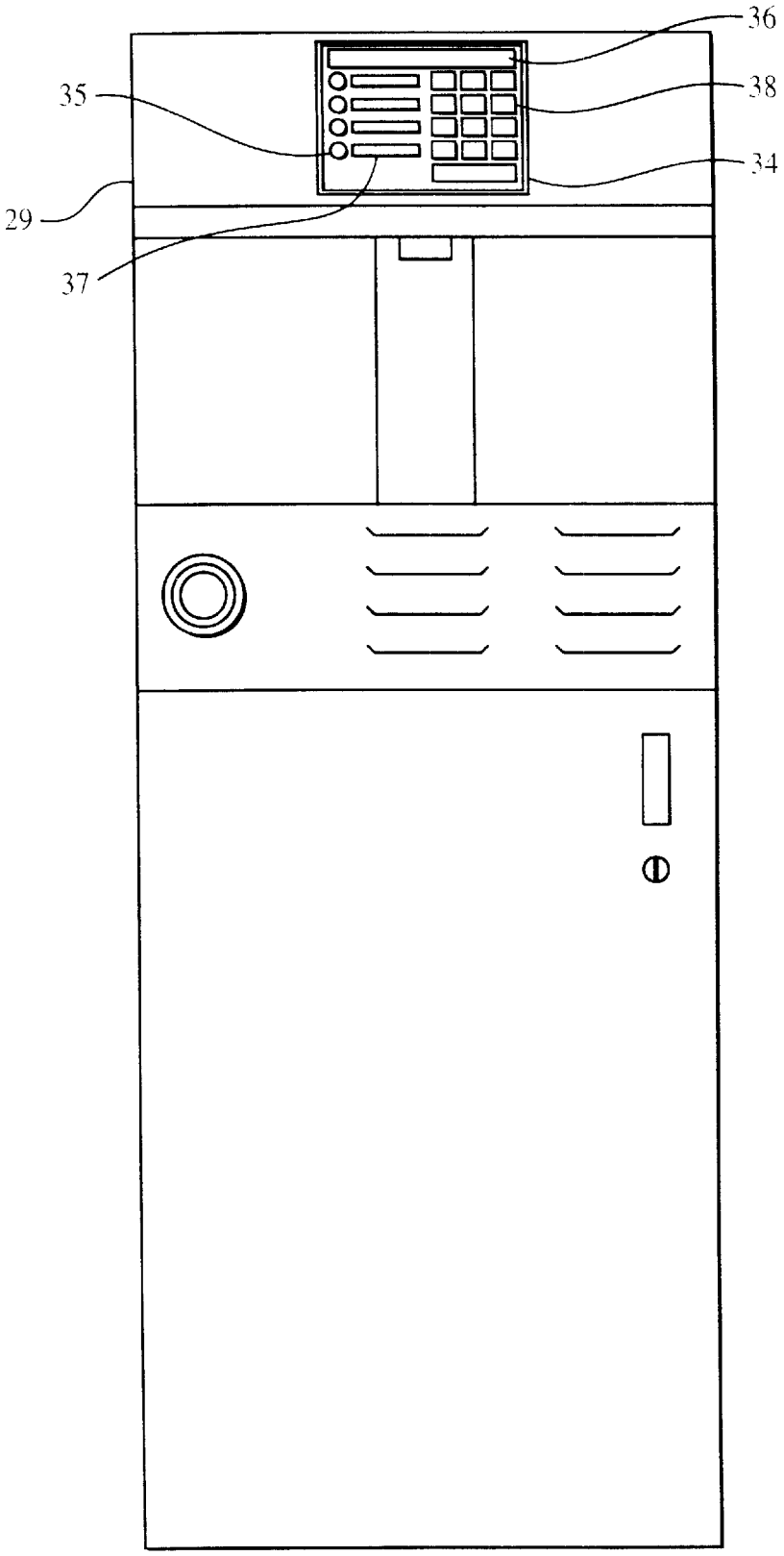
FIG. 2A represents a front view of an embodiment of a beverage dispensing system having a computer control panel according to the present invention.

FIG. 2A shows another embodiment of the beverage selection housing 29. A computerized beverage selection panel 34 is used to electronically control beverage dispensing. By pressing one of the push button beverage flow controls 35, a beverage is allowed to flow through the system and out through the beverage dispensing nozzle 33. A light emitting diode (LED) display 36 and a beverage name and quantity indicator 37 communicate information such as, the name of the beverage being selected and dispensed, the quantity of beverage remaining, and other information. An alpha numeric keypad 38 provides a means for responding to commands and for inputting information as necessary. A liquid crystal display (LCD) touch screen can be substituted for the computerized beverage selection panel 34.

Figure 2B:
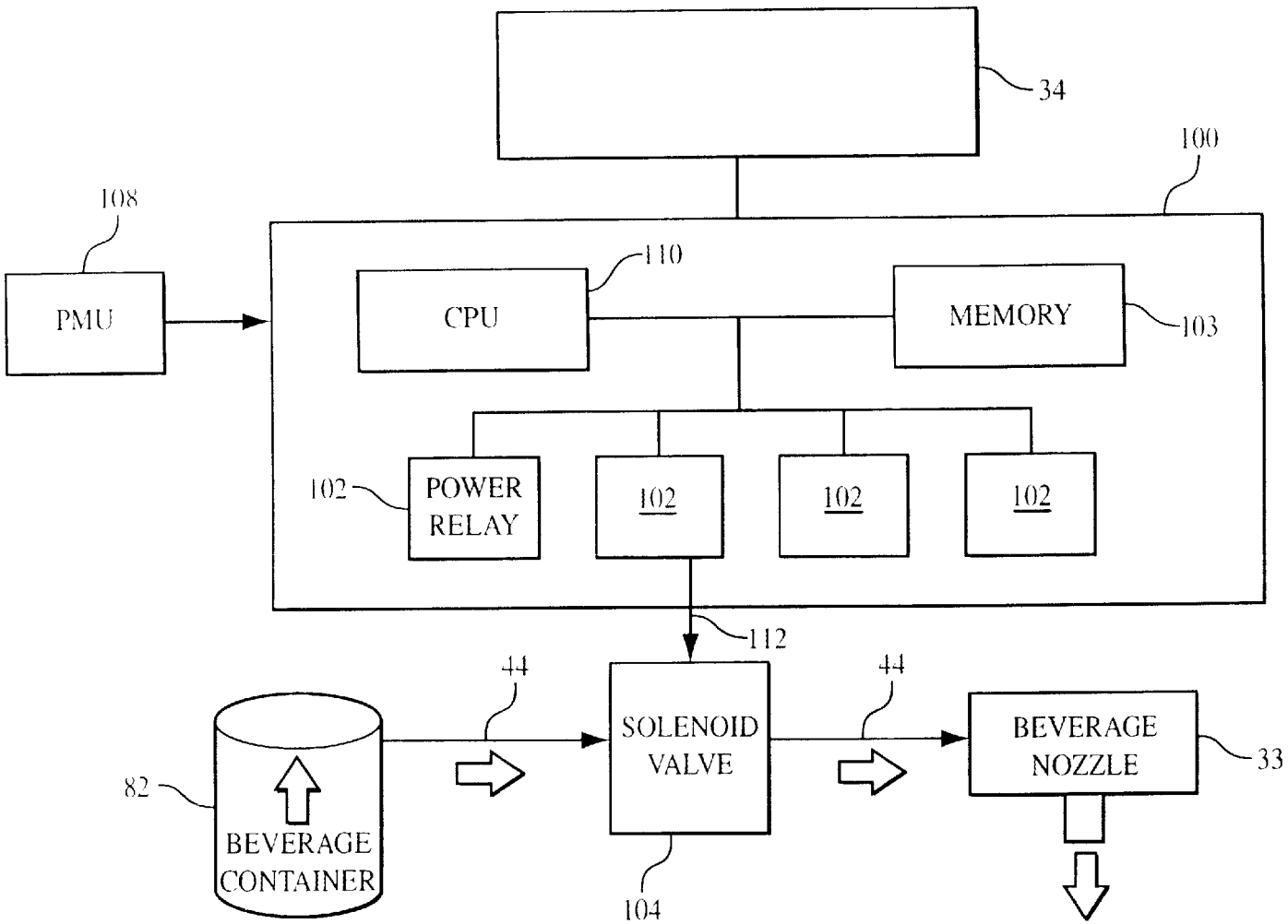
FIG. 2B shows a block diagram of a computer control system according to the present invention.

FIG. 2B shows a block diagram of a computer control system 100 that can exchange data and communicate with the computerized beverage selection panel 34. The computer control system 100 includes a central processing unit (CPU) 110 that is capable of executing programs stored in memory 103. The programs include instructions for processing requests received from a consumer using the computerized beverage selection panel 34. Such requests include requests to dispense a beverage from a particular beverage container. The programs also include instructions for outputting information associated with the beverage dispensing system 20 to the LED display 36 and the quantity indicator 37. Such information can include what type of beverage is being dispensed, what quantity remains in the beverage container, and other information.

By pressing one of the push button beverage flow controls 35, a beverage dispense request is generated. In response to the request, the CPU 110 can check the quantity of beverage remaining and send a signal to a power relay 102 based on whether any beverage is available. In turn, the power relay 102 sends a signal over an electrical connection 112 for activating a corresponding solenoid valve 104. Activating the solenoid valve 104 includes opening the valve and allowing a beverage to flow from a beverage container 82, through a hose 44, the solenoid valve 104, and out to the beverage dispensing nozzle 33. Deactivating the solenoid valve 104 causes the valve to close thereby disabling the flow of the beverage out to the beverage dispensing nozzle 33.

Each beverage container 82 is associated with a corresponding solenoid valve 104, power relay 102, hose 44, and the beverage dispensing nozzle 33. A power management unit (PMU) 108 is used to convert a standard external AC voltage source to the appropriate voltages for providing power to the computer control system 100 and to other components of the beverage dispensing system 20.

Figure 3:
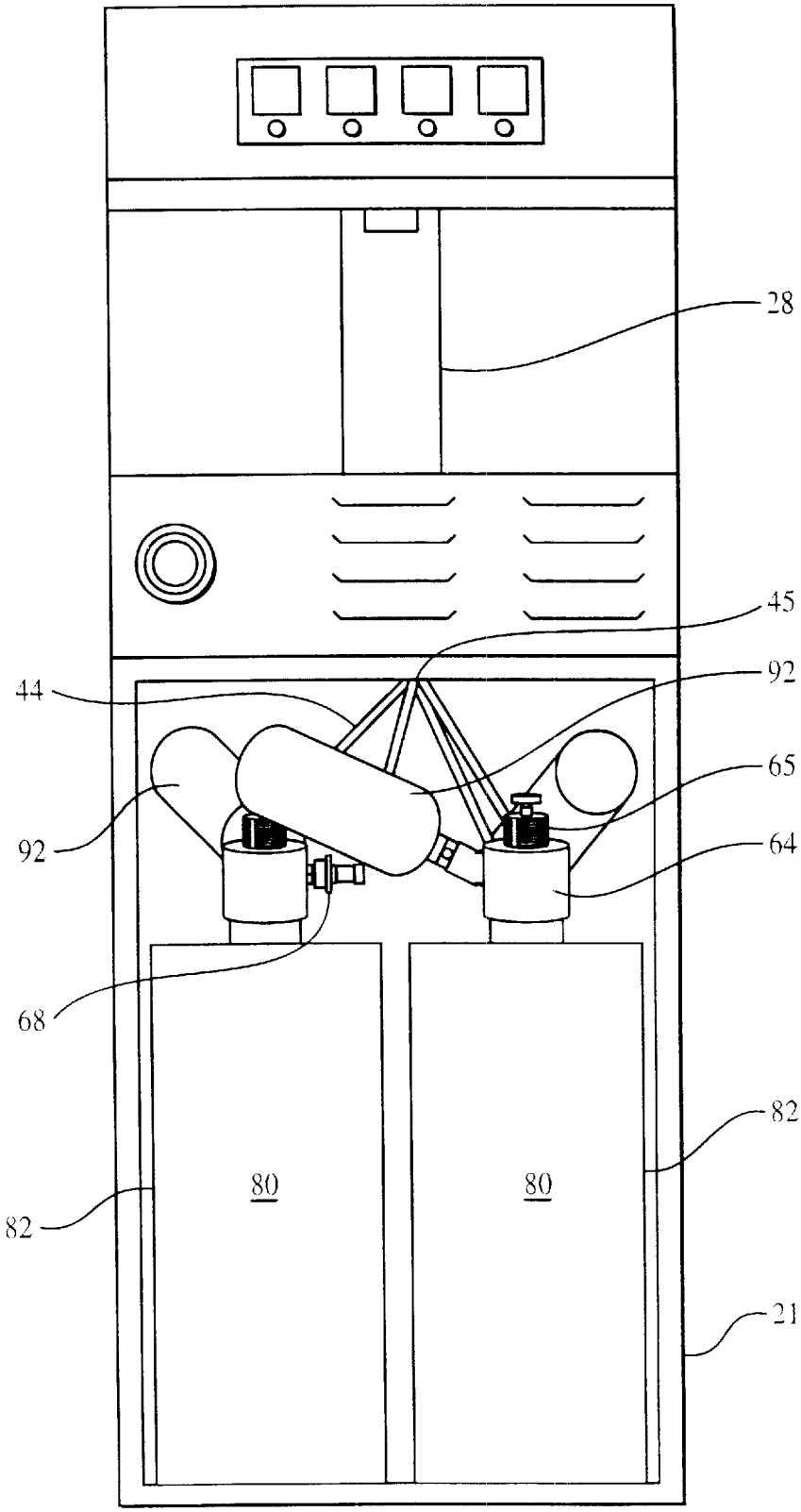
FIG. 3 is represents a cutaway view of a refrigerated compartment as part of the beverage dispensing system shown in FIG. 1.

FIG. 3 is a cutaway view of FIG. 1 illustrating the interior 45 of the refrigerated compartment 21 which is capable of housing at least one beverage container 82 containing a beverage 80. The refrigerated compartment 21 is able to maintain the temperature of the beverage containers 82 at approximately 40° Fahrenheit. The beverage container 82 is coupled to a regulator cap 64 which is also used to couple to a gas container 92. A regulator valve 65 coupled to the regulator cap and is used to regulate the gas traveling from the gas container 92, through the regulator valve 65, and into the beverage container 82. The beverage 80 in the beverage container 82 is allowed to flow out to a hose 44 from an outlet valve 68 that is coupled to the regulator cap 64. In turn, the hose 44 is connected to the beverage dispensing nozzle 33 through a solenoid valve 104. As discussed above, the electrical connection 112 between the solenoid valve 104 and the computer control system 100 is used to control the state of the valve thereby controlling the flow of the beverage through the beverage dispensing system 20.

Figure 4:
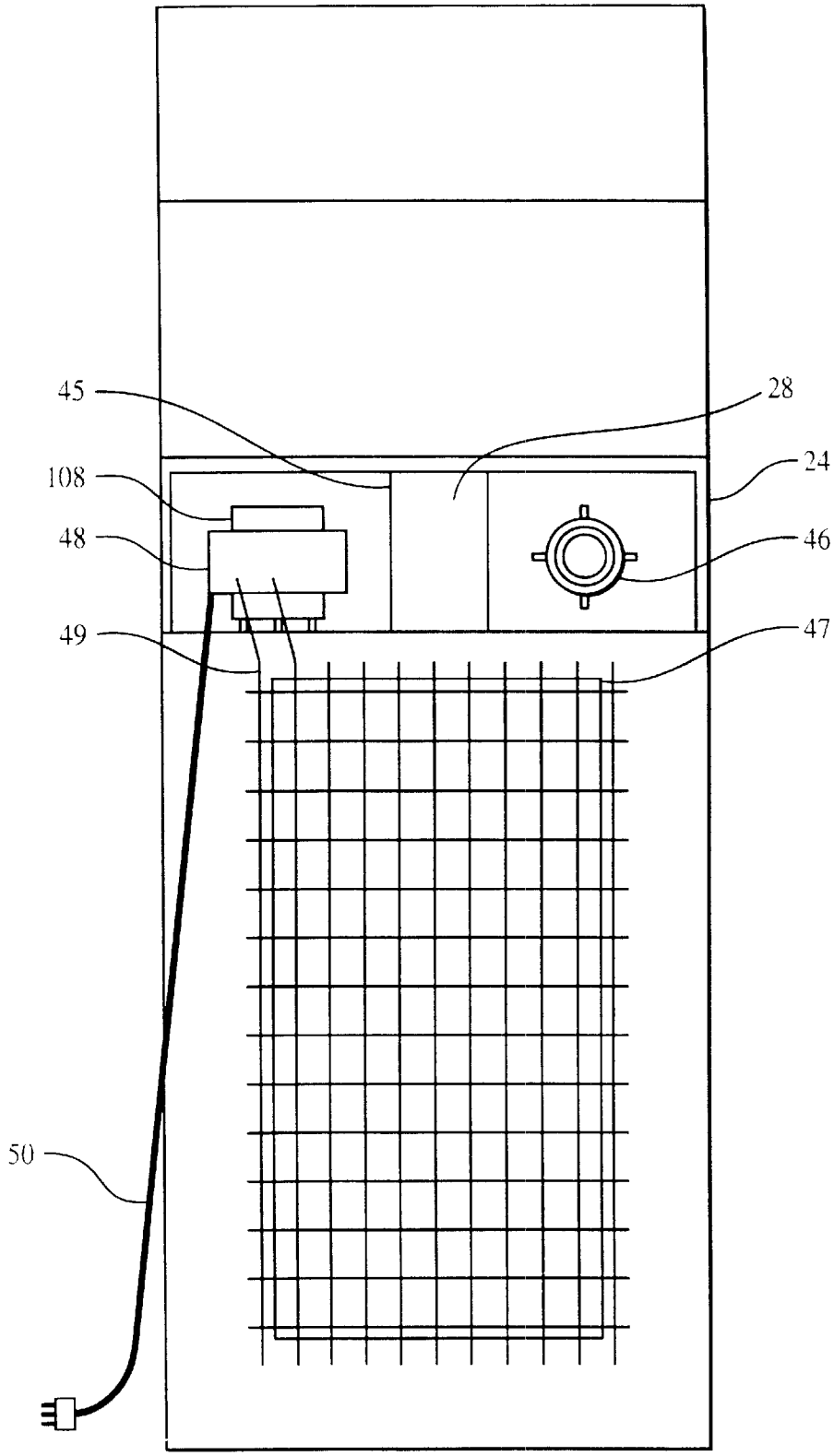
FIG. 4 represents a rear view of a beverage dispensing system according to the invention.
Figure 5:
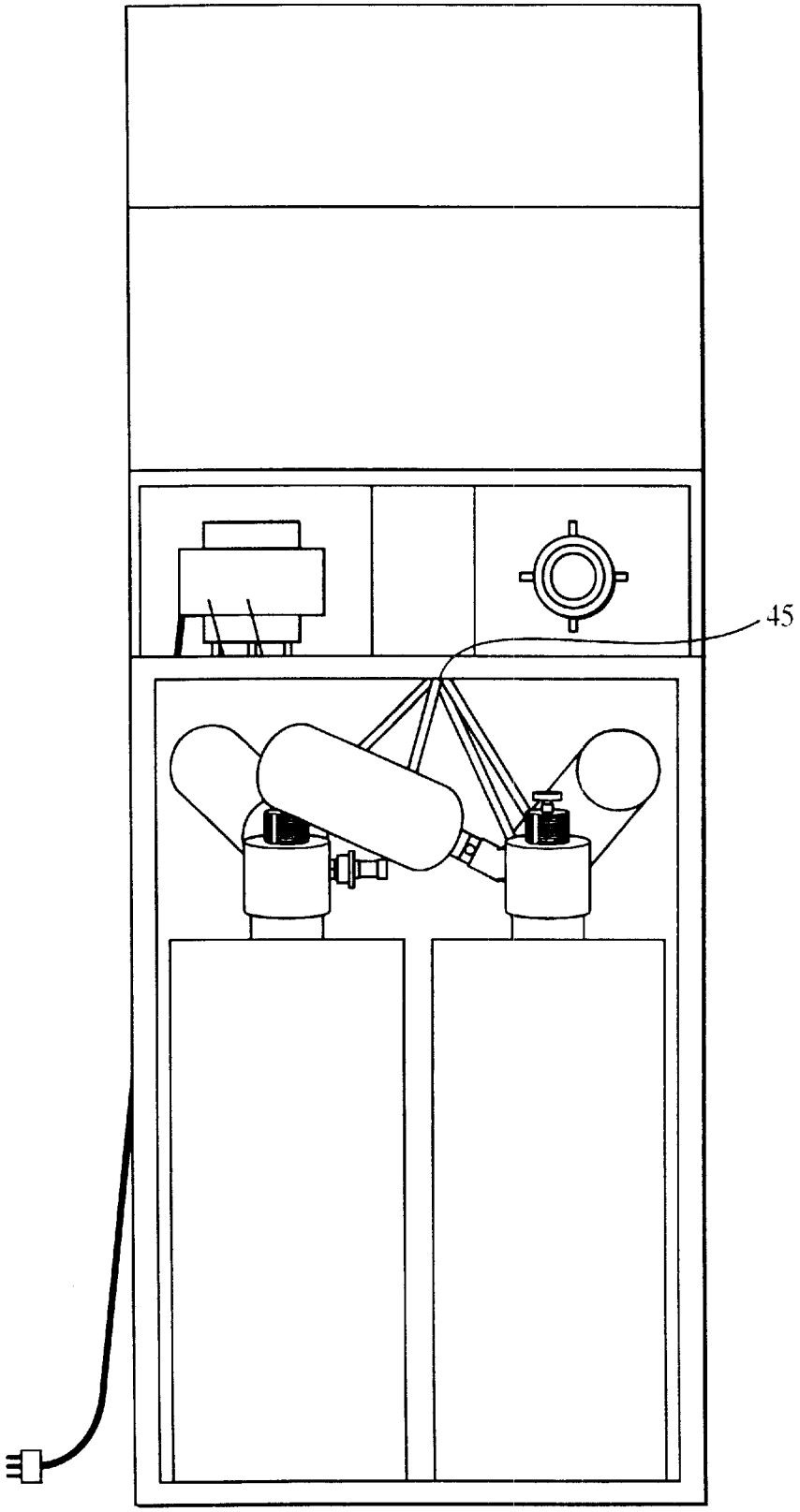
FIG. 5 represents a cutaway view of an interior of a refrigerated compartment as part of the beverage dispensing system shown in FIG. 4.

FIG. 4 is a rear view of the beverage dispensing system 20. A cup dispenser assembly 46 is attached to the inside of the vented base 24. A power cord and electrical outlet plug assembly 50 is connected to the PMU 108 which regulates and provides a voltage source for various components including the computer control system 100, a refrigerator motor 48, a cooling refrigeration unit 47, and other components. The refrigerator motor 48 provides the power for a pump that is used by a refrigeration condenser 49. These elements provide a means of cooling each beverage container 82 in the refrigerated compartment 21. Also visible from the rear view is the beverage tower 28, and FIG. 5 is a cutaway view of FIG. 4, illustrating the beverage tower opening 45.

Figure 6:
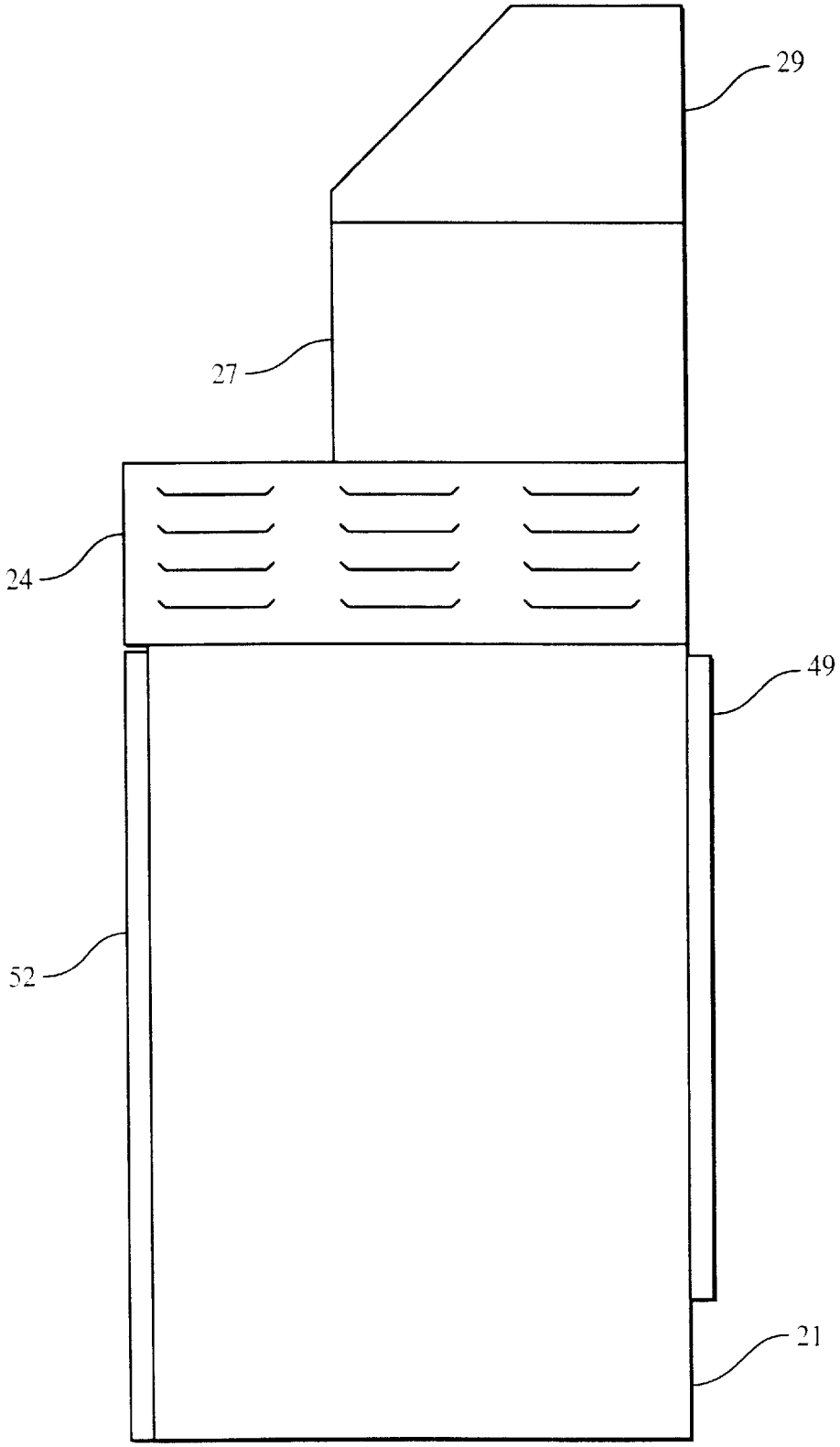
FIG. 6 represents a side view of a beverage dispensing system according to the invention.
Figure 7:
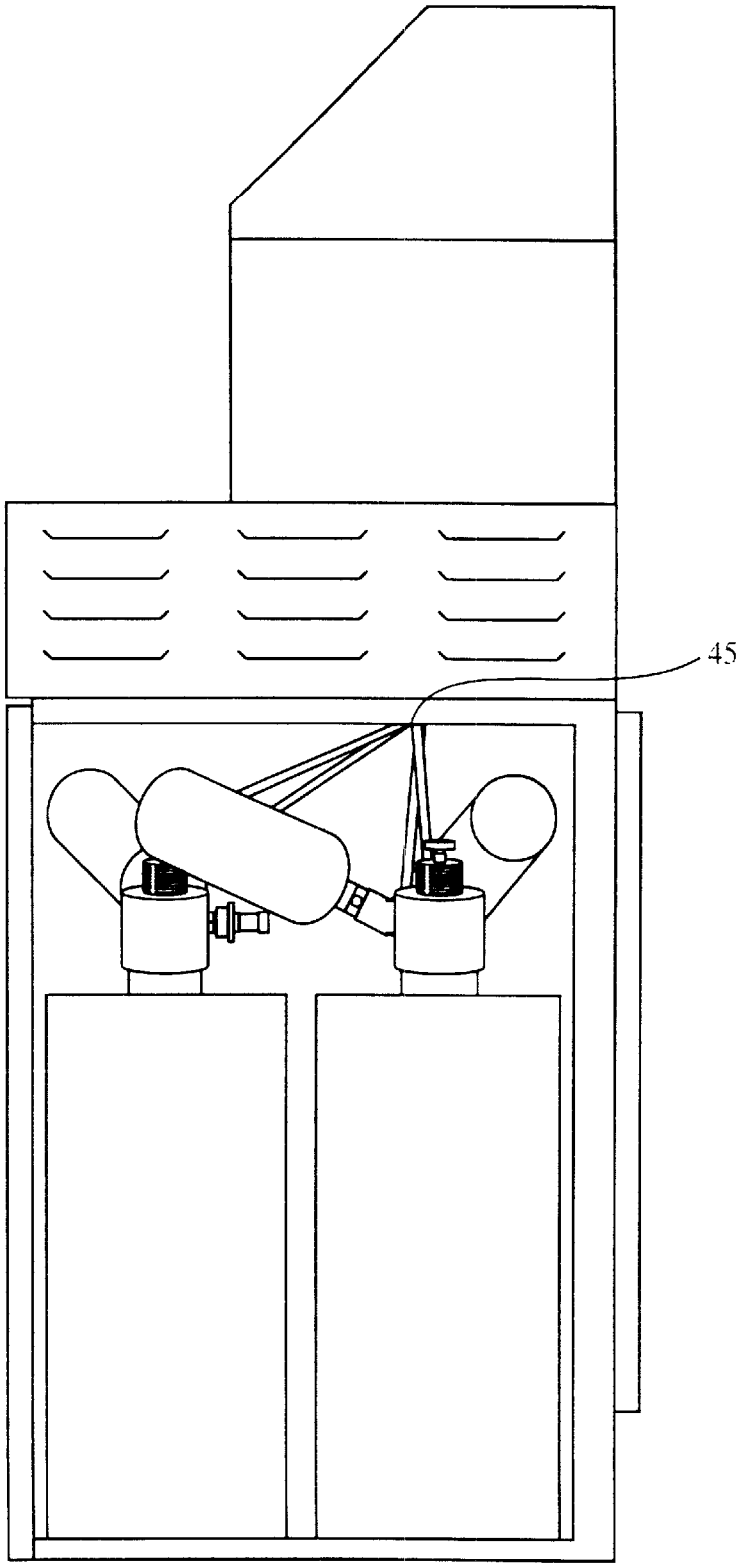
FIG. 7 represents a cutaway view of an interior of a refrigerated compartment of a beverage dispensing system shown in FIG. 6.
Figure 8B:
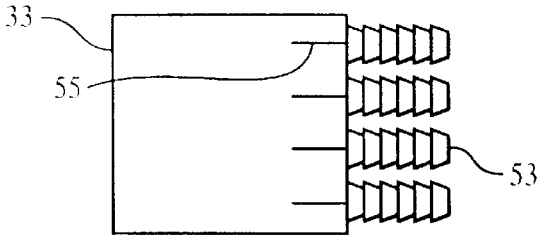
FIGS. 8A–8E represents different views of a beverage dispensing nozzle.
Figure 8C:
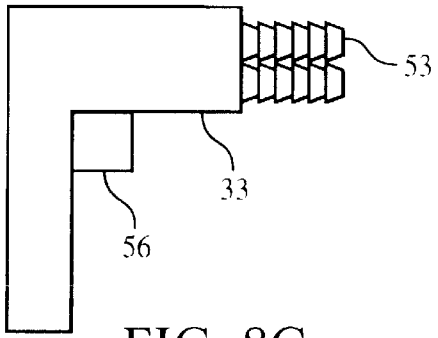
Figure 8D:
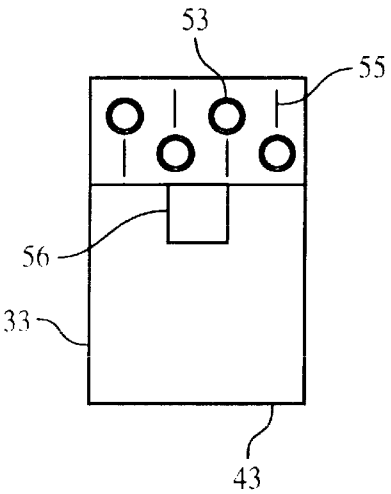
Figure 8E:
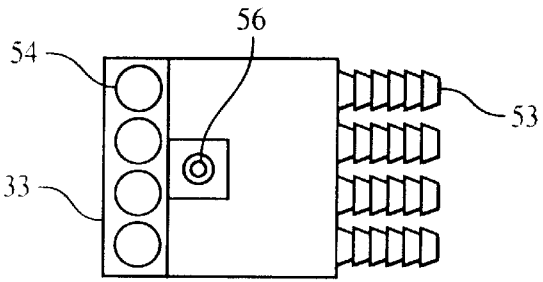
Figure 8A:
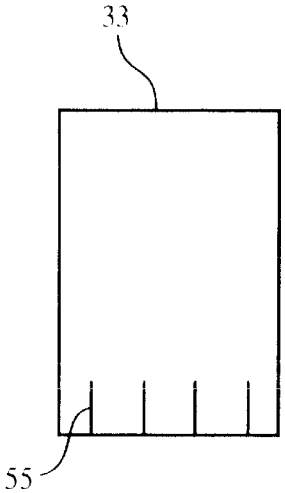
Figure 9D:
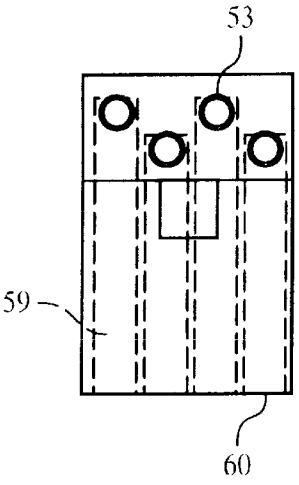
FIGS. 9A–9E represents different views of a beverage dispensing nozzle with hidden line detail.
Figure 9B:
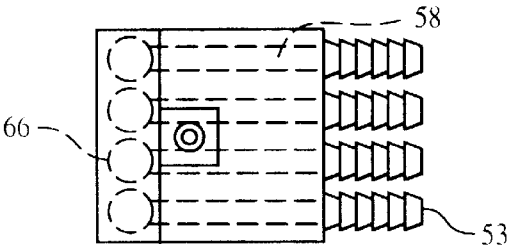
Figure 9C:
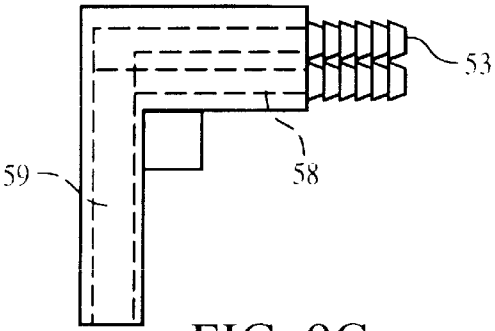
Figure 9E:
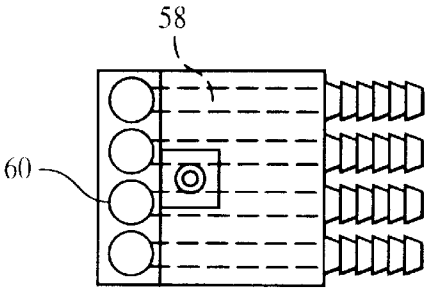
Figure 9A:
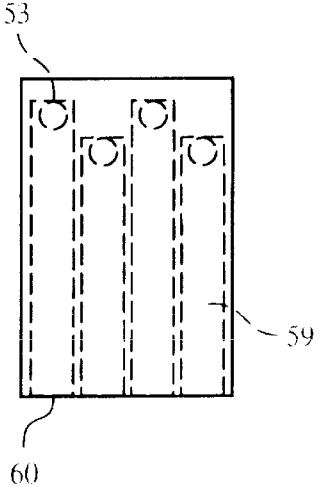

FIG. 6 is a side view of the beverage dispensing system 20 with the door 52 that is attached to the refrigerated compartment 21. Situated over the refrigerated compartment 21 are the vented base 24, tower stand 27, beverage selection panel housing 29, and the condenser 49. FIG. 7 is a cut way view of FIG. 6 showing the beverage tower opening 45 which is set back to the rear of the refrigerated compartment 21.

FIG. 8 and FIG. 9 are detailed illustrations of the beverage dispensing nozzle 33. View A is a front view, view B a top view, view C a side view, view D a rear view, and view E a bottom view. Each beverage selection indicator mark 55 has a unique color corresponding to a beverage outflow opening 54 and barbed hose fitting inflow 53. Additionally, each outlet valve 68 (FIG. 3) has a corresponding color that is related to the beverage outflow opening 54 and the barbed hose fitting inflow 53. The beverage dispensing nozzle 33 is attached to the beverage selection panel housing 29 using a screw inserted in the screw opening and housing mount 56. The barbed hose fitting inflow 53 is the connection point where the hose 44 from the solenoid valve 104 is attached, and thus permitting the flow of beverage through the barbed hose fitting outflow channel 58, down through the nozzle outflow channel 59 and exiting the nozzle opening 60.

Figure 10:
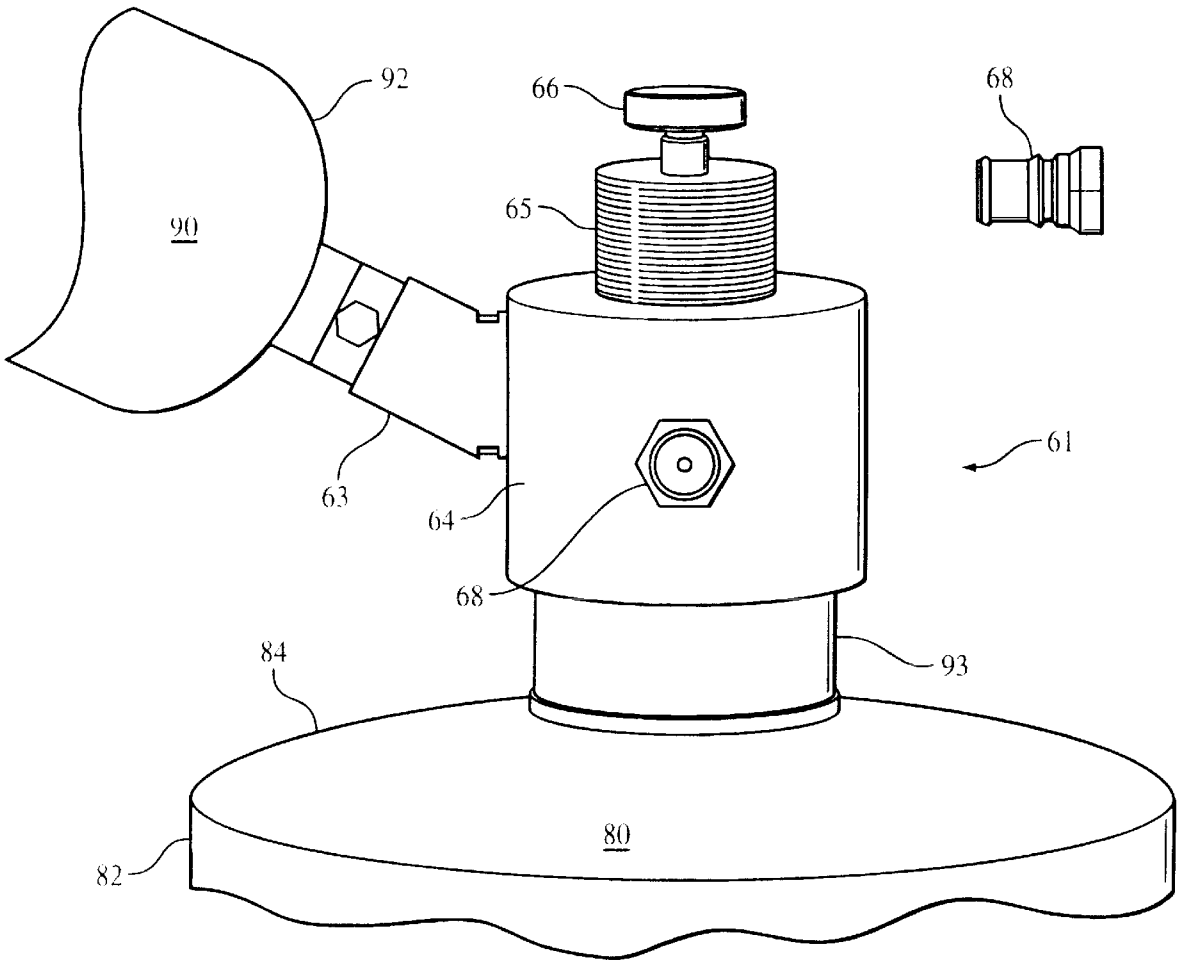
FIG. 10 represents a perspective view of a beverage container assembly according to the invention.

FIG. 10 illustrates a beverage container assembly 61 that includes a partial view of a gas container 92 having compressed gas 90. The gas container 92 is coupled to a gas coupler 63 which in turn is coupled into the body of the regulator cap 64. The gas container 92, the gas coupler 63, and the regulator cap 64 can all be coupled together using various coupling means such as threaded construction. Coupled into a top portion of the body of the regulator cap 64 is a regulator valve 65. The regulator valve 65 includes a regulating means 66 for regulating the gas flow from the gas container 92 and into the beverage container 82. An outlet valve 68 is coupled to the regulator cap body 64. The outlet valve 68 can be a ball lock valve and can have a threaded means for coupling to the body of the regulator cap 64. The regulator cap body 64 can be coupled onto the top portion of the beverage container 84 using a beverage coupler 93. The beverage coupler 93 can be implemented using, for example, a threaded means such as a threaded recess portion at the bottom of the regulator cap 64.

Figure 11:
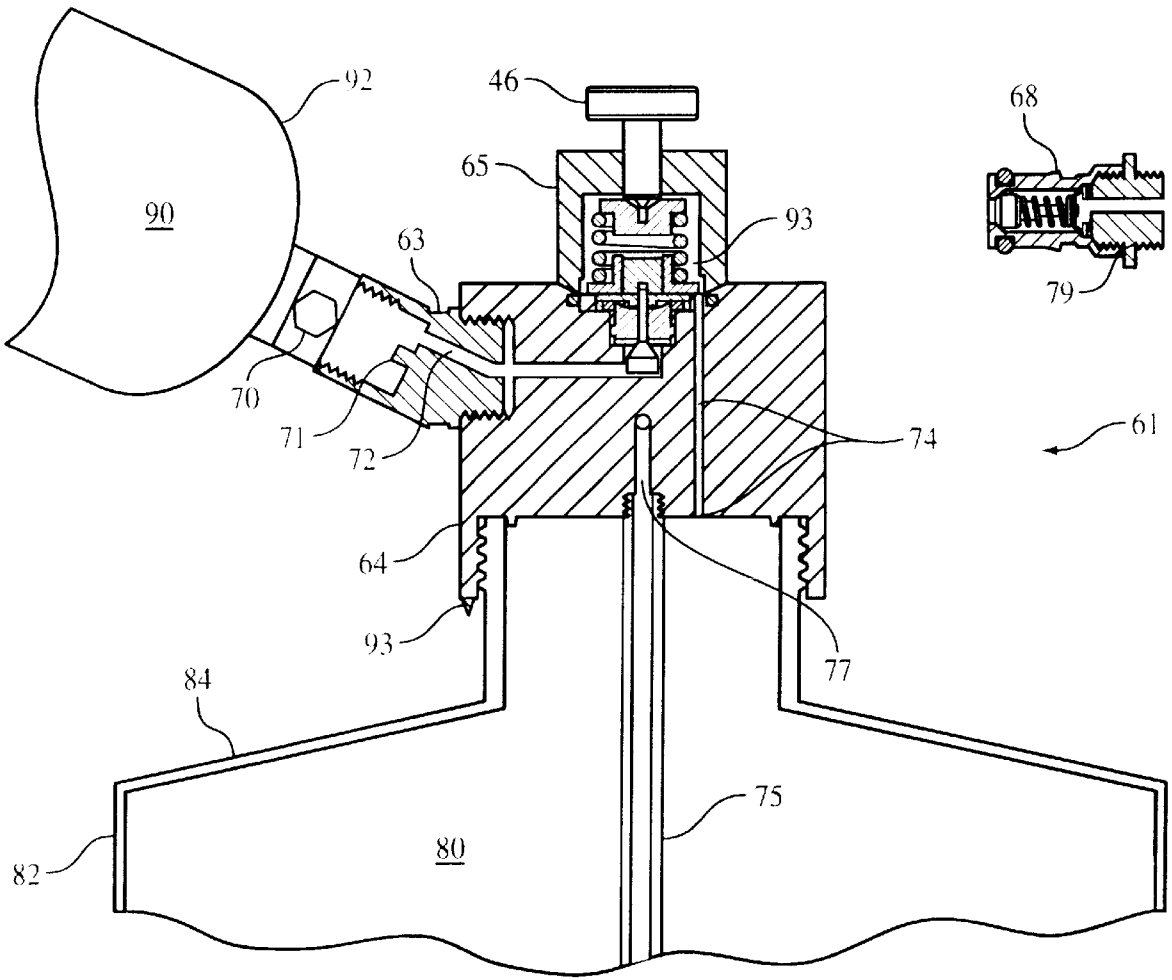
FIG. 11 represents a cross sectional view of a beverage container assembly according to the invention.

FIG. 11 is a cross sectional view of FIG. 10. The interior of the gas container 92 can contain compressed gas 90 at a pressure up to approximately 1800 psi. A burst disk 70 prevents any premature rupture of the gas container 92 should it be subjected to extreme conditions such as elevated temperatures or physical damage. The gas container 92 includes a needle valve assembly that prevents the compressed gas 90 from escaping when it is not in use such as when it is not coupled to another device. The ball lock valve 68 includes a stopper 68*a*, a spring 68*b*, a collar 68*c* and a threaded portion 68*d* for coupling to the outlet valve coupling 79. The stopper 68*a* is shown in the closed position preventing liquid from flowing out from the ball lock valve 68. On the other hand, when the ball lock valve 68 is coupled to a corresponding hose 44 (See FIG. 3), the stopper 68*a* is moved to an open position allowing liquid to flow out from the ball lock valve 68.

When the gas container 92 is coupled into the gas coupler 63, a raised portion of a pressure bottle coupling 71 depresses the needle valve assembly allowing the compressed gas 90 to escape into a first channel 72. The compressed gas 90, which is unregulated, travels from the first channel 72, through a diaphragm pressure regulator 73 (which is part of the regulator valve 65), where it is regulated using a regulating means 66 such as a regulator knob. The gas pressure is reduced down to a pressure of approximately 0 to 50 psi. The compressed gas 90 travels through a second channel 74 which carries the gas which is now regulated. The regulated gas is released into the beverage container 82 where it comes into contact with the beverage 80 and provides a downward force on the beverage enabling the beverage to flow through the beverage outflow straw 75. From the beverage outflow straw 75, the beverage travels through the outlet port 77, the outlet valve coupling 79 and then out the outlet valve 68. The outlet valve coupling 79 and the outlet valve 68 can be coupled to the body of the regulator cap 64 where the outlet port 77 is located.

By using a gas container 92 filled with different gases 90, such as carbon dioxide (CO2) and nitrogen, or a combination of both, carbonated beverages in the beverage containers 82 can be maintained at proper carbonation levels and thereby increase the freshness period of the beverages. In addition, non-carbonated beverages that use nitrogen can maintain freshness levels for extended periods of time. By utilizing these gases 90, an anaerobic environment is maintained thus greatly reducing spoilage and increasing the shelf life of the beverages.

Figure 12:
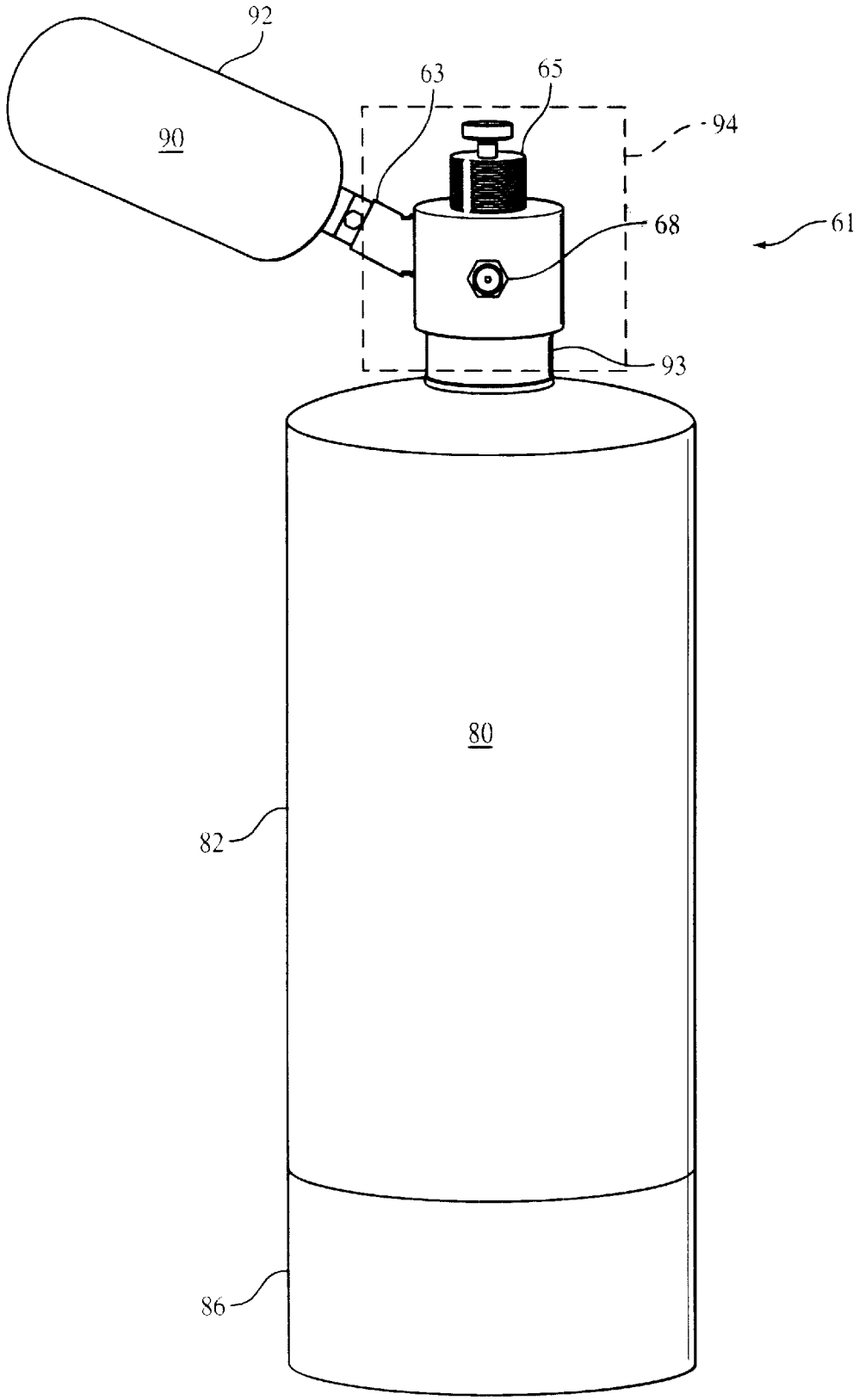
FIG. 12 represents a perspective view of a beverage container assembly.

FIG. 12 illustrates a beverage container assembly 61 including a gas container 92, a beverage container 82, and a regulator cap assembly 94. The regulator cap assembly 94 includes a gas coupler 63, a beverage coupler 93, a regulator valve 65, and an outlet valve 68. The beverage container 82 is capable of holding different beverages 80 depending on the height of the beverage container 82 since the diameter of the beverage container is a standard size. The lower portion of the beverage container 86 is reinforced to prevent breakage. Each beverage container 82 can be constructed of standard materials such as polyethylene-terephthalate, stainless steel, or other standard materials. Each beverage container 82 is capable of holding any beverage 80 including any combination of non-alcoholic and alcoholic beverages such as water, beer, juice, or other beverages.

A number of embodiments of the invention have been described. Nevertheless, it will be understood that various modifications may be made without departing from the spirit and scope of the invention. For example, the beverage dispensing system 20 can be adapted to house and dispense from various combinations of beverage containers 82 such as four standard size beverage containers, six smaller sized beverage containers, or other combinations. Accordingly, other embodiments are within the scope of the following claims.

What is claimed is:

1. A regulator cap assembly comprising:

a beverage coupler for receiving a beverage container for holding a beverage;

a gas coupler for receiving a gas container for holding compressed gas, wherein the gas coupler includes a first channel; and a regulator valve having a first end connected to the first channel through which the compressed gas travels, and the regulator valve having a second end connected to a second channel through which the compressed gas is allowed to travel such that the compressed gas fills the beverage container enabling the beverage in the beverage container to flow out through an outlet valve, wherein the regulator valve includes a regulating knob for regulating the pressure of the compressed gas that passes through the regulator valve.

2. The system of claim 1, wherein the gas coupler uses a threaded means for receiving the gas container.

3. The system of claim 1, wherein the beverage coupler uses a threaded means for receiving the beverage container.

4. The system of claim 1, wherein the outlet valve is a ball lock valve.

5. The system of claim 1, wherein the regulator valve is a diaphragm regulator valve.

6. The system of claim 1, wherein the regulator valve regulates the compressed gas in the first channel from approximately 1800 psi to approximately 0 to 50 psi in the second channel.

7. A beverage dispensing system comprising:

at least one beverage container assembly, wherein each beverage container assembly comprises:

a beverage container for holding a beverage, gas container for holding compressed gas, and a regulator cap assembly comprising:

a beverage coupler for receiving the beverage container, a gas coupler for receiving the gas container, wherein the gas coupler includes a first channel, a regulator valve having a first end connected to the first channel through which the compressed gas travels, and a second end connected to a second channel through which the compressed gas is allowed to travel, such that the compressed gas fills the beverage container enabling the beverage in the beverage container to flow out through an outlet valve, wherein the regulator valve includes a regulating knob for regulating the pressure of the compressed gas that passes through the regulator valve;

a refrigerated compartment for housing each beverage container assembly; and a controlling means for controlling the flow of the beverage between the outlet valve and a beverage dispensing nozzle.

8. The system of claim 7, wherein the gas coupler uses a threaded means for receiving the gas container.

9. The system of claim 7, wherein the beverage coupler uses a threaded means for receiving the beverage container.

10. The system of claim 7, wherein the controlling means controls the flow of the beverage using a solenoid valve.

11. The system of claim 7, wherein the outlet valve is a ball lock valve.

12. The system of claim 7, wherein the temperature within the refrigerated compartment is maintained at approximately 40° Fahrenheit.

13. The system of claim 7, wherein the regulator valve is a diaphragm regulator valve.

14. The system of claim 7, wherein the regulator valve regulates the compressed gas in the first channel from approximately 1800 psi to approximately 0 to 50 psi in the second channel.

15. The system of claim 7, wherein the gas container contains at least one of a carbon dioxide gas and nitrogen gas at a pressure of approximately 1800 psi.

* * * * *